US008529198B2

(12) United States Patent
Burdgick

(10) Patent No.: US 8,529,198 B2
(45) Date of Patent: Sep. 10, 2013

(54) EXTERNAL ADJUSTMENT AND MEASUREMENT SYSTEM FOR STEAM TURBINE NOZZLE ASSEMBLY

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 431 days.

(21) Appl. No.: 12/941,634

(22) Filed: Nov. 8, 2010

(65) Prior Publication Data

US 2012/0114470 A1 May 10, 2012

(51) Int. Cl.
*F04D 29/40* (2006.01)

(52) U.S. Cl.
USPC ..... 415/126; 415/214.1

(58) Field of Classification Search
USPC ..... 415/213.1, 214.1, 209.2, 209.3, 209.4, 415/182.1, 126, 127, 128, 200; 29/889.22
See application file for complete search history.

(56) References Cited

U.S. PATENT DOCUMENTS

| | | | | |
|---|---|---|---|---|
| 3,592,557 | A | 7/1971 | Haas et al. | |
| 6,655,911 | B2 * | 12/2003 | Bekrenev | 415/116 |
| 7,329,098 | B2 | 2/2008 | Burdgick | |
| 2006/0251514 | A1 * | 11/2006 | Burdgick | 415/214.1 |
| 2011/0250063 | A1 * | 10/2011 | Burdgick et al. | 415/209.2 |

OTHER PUBLICATIONS

Edgar, U.S. Appl. No. 12/946,977, Office Action Communication, Jun. 27, 2013, 8 pages.

* cited by examiner

*Primary Examiner* — Edward Look
*Assistant Examiner* — Juan G Flores
(74) *Attorney, Agent, or Firm* — Hoffman Warnick LLC

(57) ABSTRACT

A remote adjustment and measurement system for a steam turbine nozzle assembly is disclosed. In one embodiment, a steam turbine casing segment is disclosed including: a horizontal joint surface; a pocket having a first opening at the horizontal joint surface and a second opening facing substantially radially outward; and a port accessible from a radially outward surface of the steam turbine casing segment, the port fluidly connected to the second opening of the pocket.

18 Claims, 4 Drawing Sheets

EXTERNAL ADJUSTMENT AND MEASUREMENT SYSTEM FOR STEAM TURBINE NOZZLE ASSEMBLY

BACKGROUND OF THE INVENTION

The subject matter disclosed herein relates to a steam turbine nozzle assembly, or diaphragm stage. Specifically, the subject matter disclosed herein relates to an external adjustment and measurement system for a steam turbine nozzle assembly.

Steam turbines include static nozzle assemblies that direct flow of a working fluid into turbine buckets connected to a rotating rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm.

Conventionally, the nozzle assembly stages are aligned either with the rotor in place, or without the rotor, using a hard wire or laser measurement. In one conventional approach, the lower half of the nozzle assembly stage (or, nozzle lower half) and the rotor are aligned without the upper half of the nozzle assembly stage (or, upper half) and/or the upper half of the casing in place. In this approach, measurements are made between the lower half and the rotor at the bottom and each respective side of the turbine. In a second conventional approach, the nozzle upper half and casing upper half (as well as the respective lower haves) are in place without the rotor. In this approach, measurements are made between the bearing centerline locations and the nozzle assembly centerline. In either approach, the casing, rotor and/or nozzle assemblies must be removed in order to horizontally and vertically align these parts with respect to the rotor. These adjustments may be costly and time-consuming.

BRIEF DESCRIPTION OF THE INVENTION

A remote adjustment and measurement system for a steam turbine nozzle assembly is disclosed. In one embodiment, a steam turbine casing segment is disclosed including: a horizontal joint surface; a pocket having a first opening at the horizontal joint surface and a second opening facing substantially radially outward; and a port accessible from a radially outward surface of the steam turbine casing segment, the port fluidly connected to the second opening of the pocket.

A first aspect of the invention includes a steam turbine casing segment including: a horizontal joint surface; a pocket having a first opening at the horizontal joint surface and a second opening facing substantially radially outward; and a port accessible from a radially outward surface of the steam turbine casing segment, the port fluidly connected to the second opening of the pocket.

A second aspect of the invention includes a steam turbine apparatus having: a diaphragm segment; a casing segment at least partially housing the diaphragm segment, the casing segment having: a horizontal joint surface; a pocket having a first opening at the horizontal joint surface and a second opening facing substantially radially outward; and a port accessible from a radially outward surface of the steam turbine casing segment, the port fluidly connected to the second opening of the pocket; a support member positioned within the pocket; a support bar at least partially coupling the casing segment to the diaphragm segment, the support bar contacting the support member; and an adjustment assembly within the port and contacting the support member, the adjustment assembly configured to actuate movement of the support bar via the support member.

A third aspect of the invention includes a steam turbine system having: an upper casing segment; and a lower casing segment coupled to the upper casing segment at a casing horizontal joint surface, the lower casing segment including: a pocket having a first opening at the horizontal joint surface and a second opening facing substantially radially outward; and a port accessible from a radially outward surface of the steam turbine casing segment, the port fluidly connected to the second opening of the pocket.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for an adjustment and measurement system for a steam turbine nozzle assembly. In some embodiments, aspects of the invention provide for an external adjustment and measurement system for a steam turbine nozzle assembly.

In contrast to conventional approaches, aspects of the invention provide for an adjustment and measurement system for a steam turbine that reduces the time, cost and labor involved in aligning the steam turbine nozzle assembly, casing and rotor. In one embodiment, aspects of the invention provide for a steam turbine apparatus comprising: a diaphragm segment; a casing segment at least partially housing the diaphragm segment, the casing segment having: a horizontal joint surface; a pocket having a first opening at the horizontal joint surface and a second opening facing substantially radially outward; and a port accessible from a radially outward surface of the steam turbine casing segment, the port fluidly connected to the second opening of the pocket; a support member positioned within the pocket; a support bar at least partially coupling the casing segment to the diaphragm segment, the support bar contacting the support member; and an adjustment assembly within the port and contacting the support member, the adjustment assembly configured to actuate movement of the support bar via the support member.

Figure 1:
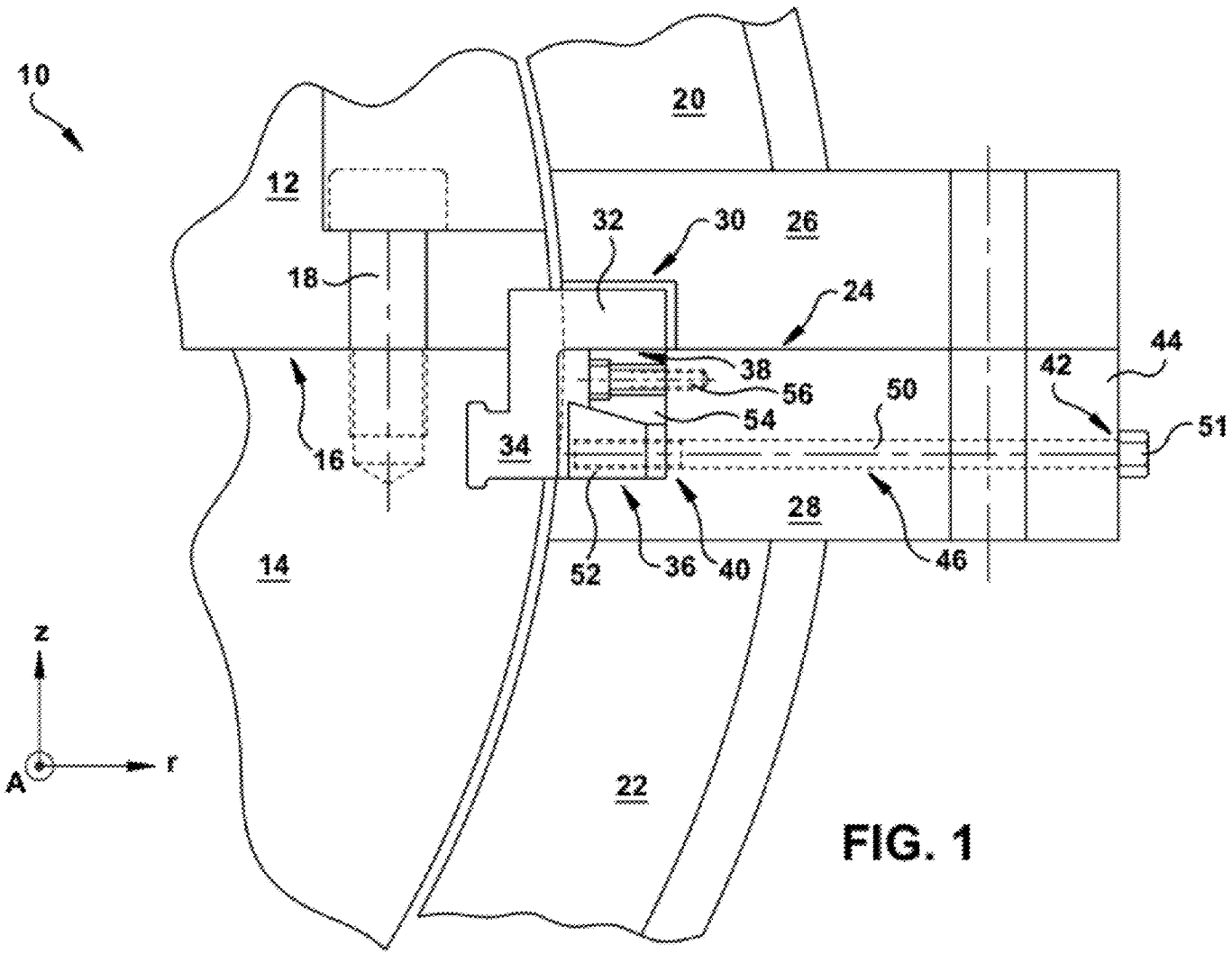
FIG. 1 shows a partial end elevation of a steam turbine nozzle adjustment and measurement system according to embodiments of the invention.

Turning to FIG. 1, a partial end elevation of a steam turbine apparatus 10 is shown according to embodiments of the invention. In one embodiment, the steam turbine apparatus 10 may include an upper diaphragm segment 12 and a lower diaphragm segment 14 joined at a diaphragm horizontal joint surface 16 (interface between diaphragm segments). In one embodiment, upper diaphragm segment 12 and lower diaphragm segment 14 may be joined by at least one bolt 18. Also shown at least partially housing diaphragm segments (12, 14) is a casing, including an upper casing segment 20 and a lower casing segment 22 joined at a casing horizontal joint surface 24 (interface between casing segments). In one embodiment, upper casing segment 20 and lower casing segment 22 may each include a support arm 26, 28, respectively. As shown, upper casing segment 20 may include a slot 30 configured to receive an overhanging portion 32 of a support bar 34, as is known in the art. Lower casing segment 22 may include a pocket 36 having a first opening 38 at the casing horizontal joint surface 24 (first opening 38 obscured in this two-dimensional view). Pocket 36 may further include a second opening 40 opening facing substantially radially outward (away from diaphragm segment 14 in the radial direction, indicated by the r-axis).

Lower casing segment 22 is further shown including a port 42 accessible from a radially outward surface 44 of lower casing segment 22. In one embodiment, port 42 is fluidly connected to second opening 40 via, e.g., a channel or path 46. In one embodiment port 42 (and consequently, path 46) may be substantially filled and sealed by a portion of an adjustment assembly 47 (FIG. 2, where labeling in FIG. 1 is omitted for clarity of illustration). In one embodiment, port 42 (and consequently, path 46 may be substantially filled and sealed by adjustment bolt 50 (e.g., a bolt or screw, which may extend substantially radially), having a lug 51. It is further understood that the adjustment assembly 47 (labeled in FIG. 2) may include an adjustment member 52, which may include, e.g., a member having an angled face (labeled in FIG. 2).

Also shown included in steam turbine apparatus 10 is a support member 54 positioned within pocket 36. In one embodiment, support member 54 may be configured to contact support bar 34 and may be configured to vertically support the support bar 34 at overhanging portion 32. In one embodiment, support member 54 may include a metal including, e.g., steel. Support member 54, in some cases, may be removably affixed to lower casing segment 22 (e.g., at support arm 28) via a bolt 56 (e.g., a shoulder bolt) or other attachment mechanism. For example, in some cases, support member 54 may be removably affixed to lower casing segment 22 via a pin or a screw. In one embodiment, lower casing segment 22 may include an aperture (e.g., a threaded aperture that may extend substantially radially outward, labeling omitted for clarity of illustration) configured to receive bolt 56 or another attachment mechanism for retaining support member 54 within pocket 36. As described further herein, support member 54 may include an angled face configured to interact with an angled face of the adjustment member 52, and actuate movement of the casing horizontal joint surface 24 with respect to diaphragm horizontal joint surface 16.

Figure 2:
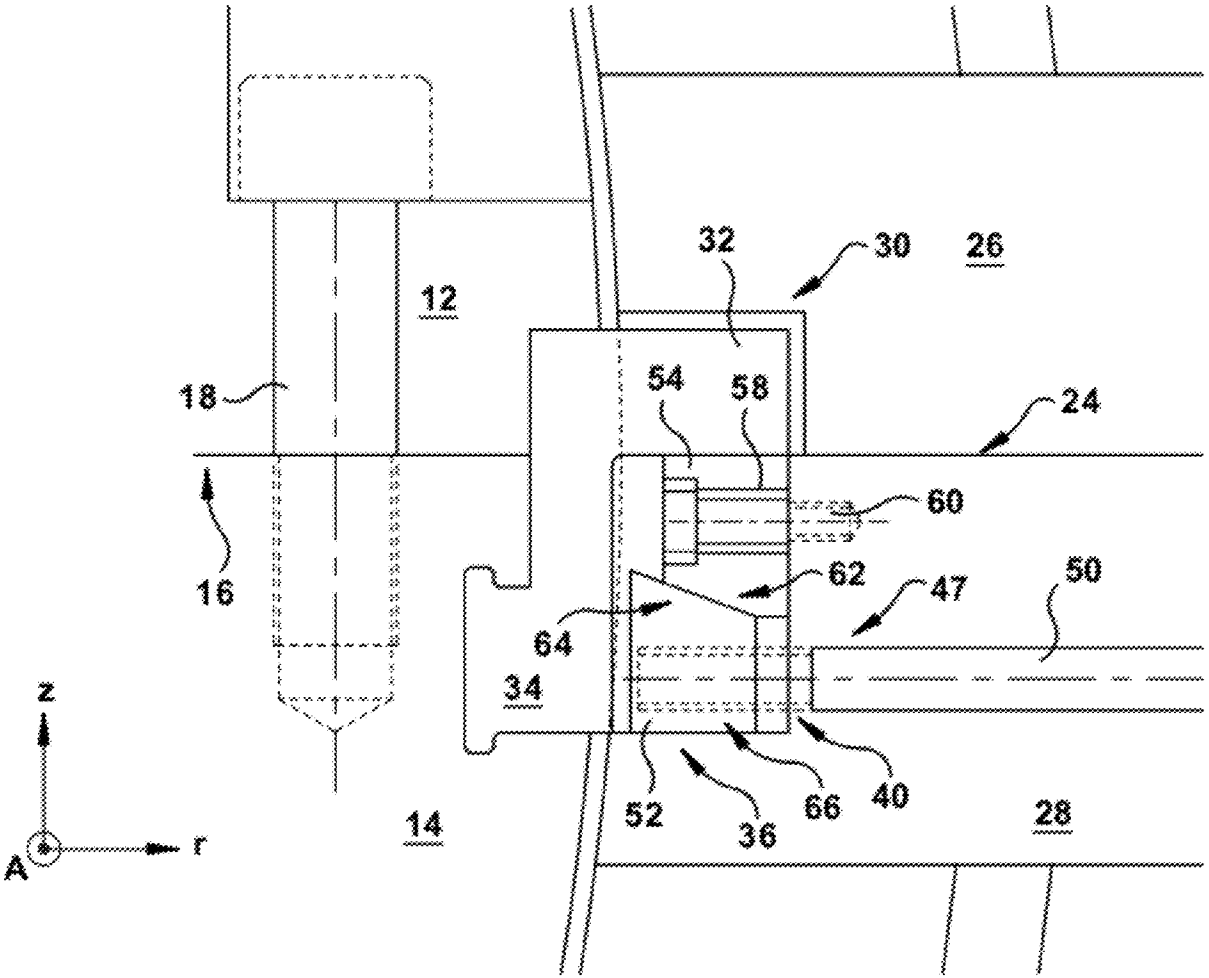
FIG. 2 shows a close-up partial end elevation of the steam turbine apparatus of FIG. 1.

FIG. 2 shows a close-up partial end elevation of the steam turbine apparatus 10 of FIG. 1. As shown in this close-up view, support member 54 may include an aperture 58 extending at least partially therethrough, the aperture 58 being configured to receive an attachment mechanism, e.g., a bolt 60, for coupling the support member 54 to lower casing segment (at support arm 28). Support member 54 may further include an angled face 62, configured to interact with a substantially complementary angled face 64 of adjustment member 52. As is described further herein with respect to adjustment assembly 47, the interaction of angled faces (62, 64), allows for translation of horizontal movement of adjustment bolt 50 (and adjustment member 52) into vertical (up or down along the z-axis) movement of support member 54, and consequently, casing horizontal joint surface 24.

In one embodiment, adjustment member 52 includes an aperture 66, e.g., a threaded aperture configured to receive a portion of adjustment bolt 50. In one embodiment, the aperture 66 may include a counter-bore portion for retaining adjustment bolt 50 at a position with respect to adjustment member 52. In some embodiments, adjustment bolt 50 may be retained by a retaining member (not visible in this perspective) such as a retaining plate, tab, wire, etc. configured to fix adjustment bolt 50 in a desired position along the r-axis. In case, it is understood that adjustment member 52 and adjustment bolt 50 may be substantially coupled such that displacement of adjustment bolt 50 in the radial direction (r-axis) results in similar displacement of adjustment member 52 in the radial direction.

Figure 3:
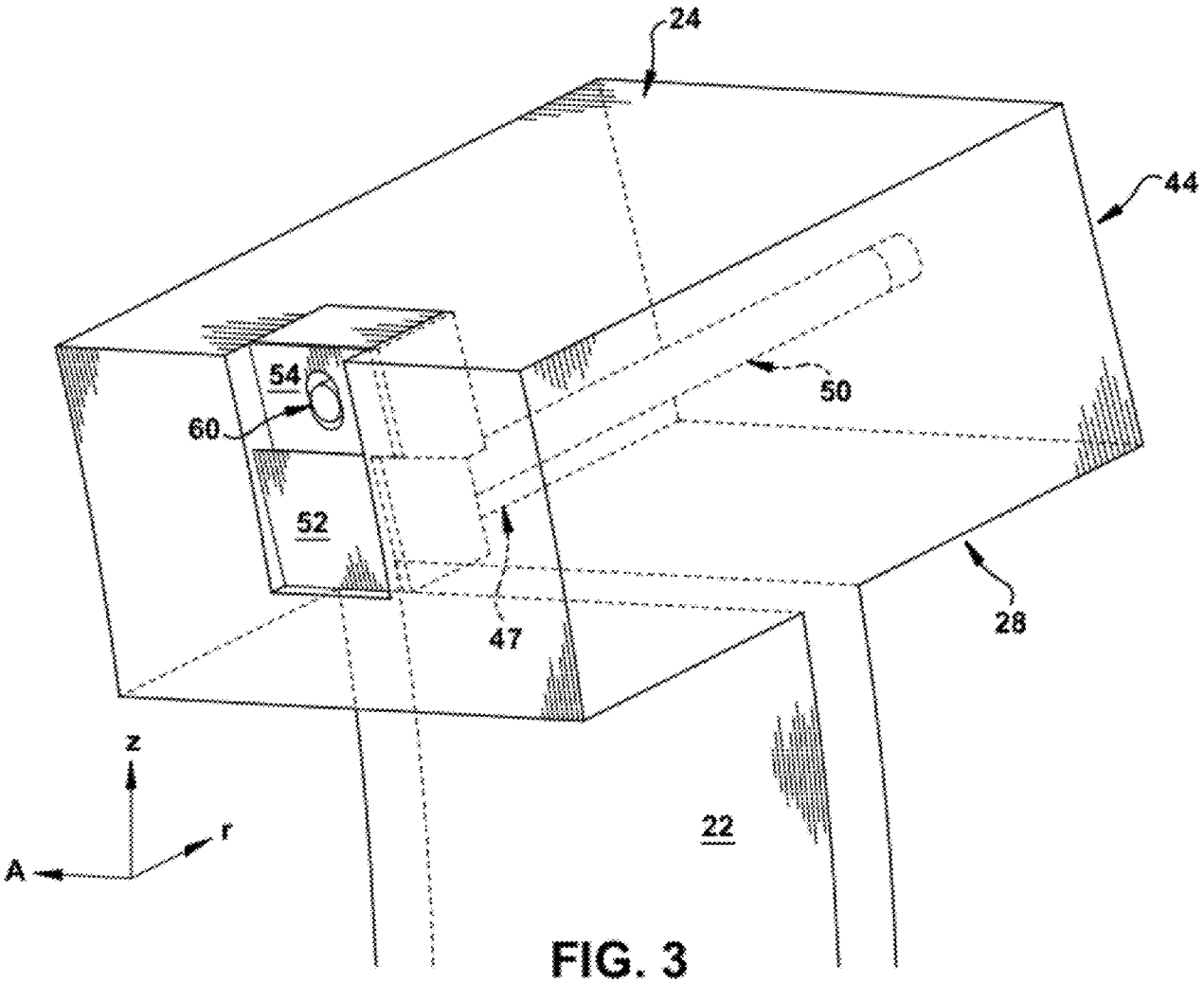
FIG. 3 shows a partial cut-away three-dimensional perspective view of a steam turbine system according to embodiments of the invention.

Turning to FIG. 3, a partial cut-away three-dimensional perspective view of the lower casing segment 22, as well as adjustment assembly 47 (including the adjustment member 52 and adjustment bolt 50) and support member 54 is shown. Also shown is bolt 60 (e.g., a retaining shoulder bolt) or other attachment mechanism. As seen from this perspective, adjustment bolt 50 is accessible from the radially outward surface 44, such that the radial position of adjustment bolt 50 may be adjusted while the steam turbine system is closed (e.g., when the casing horizontal joint surface 24 is not accessible). It is understood that the angles at which angled faces (62, 64, FIG. 2) are formed may dictate the amount of vertical (z-axis) displacement that adjustment assembly 47 can impart on support member 54. That is, a steeper angled face may allow for greater vertical displacement of support member 54 by adjustment member 52, however, this steeper angle will increase the stresses placed on support member 54 and adjustment member 52. In one embodiment, the angled faces (62, 64) may be formed at approximately five (5) to twenty-five (25) degrees with respect to normal. More specifically, in some embodiments, the angled faces (62, 64) may be formed at approximately ten (10) to approximately fifteen (15) degrees with respect to normal.

Figure 4:
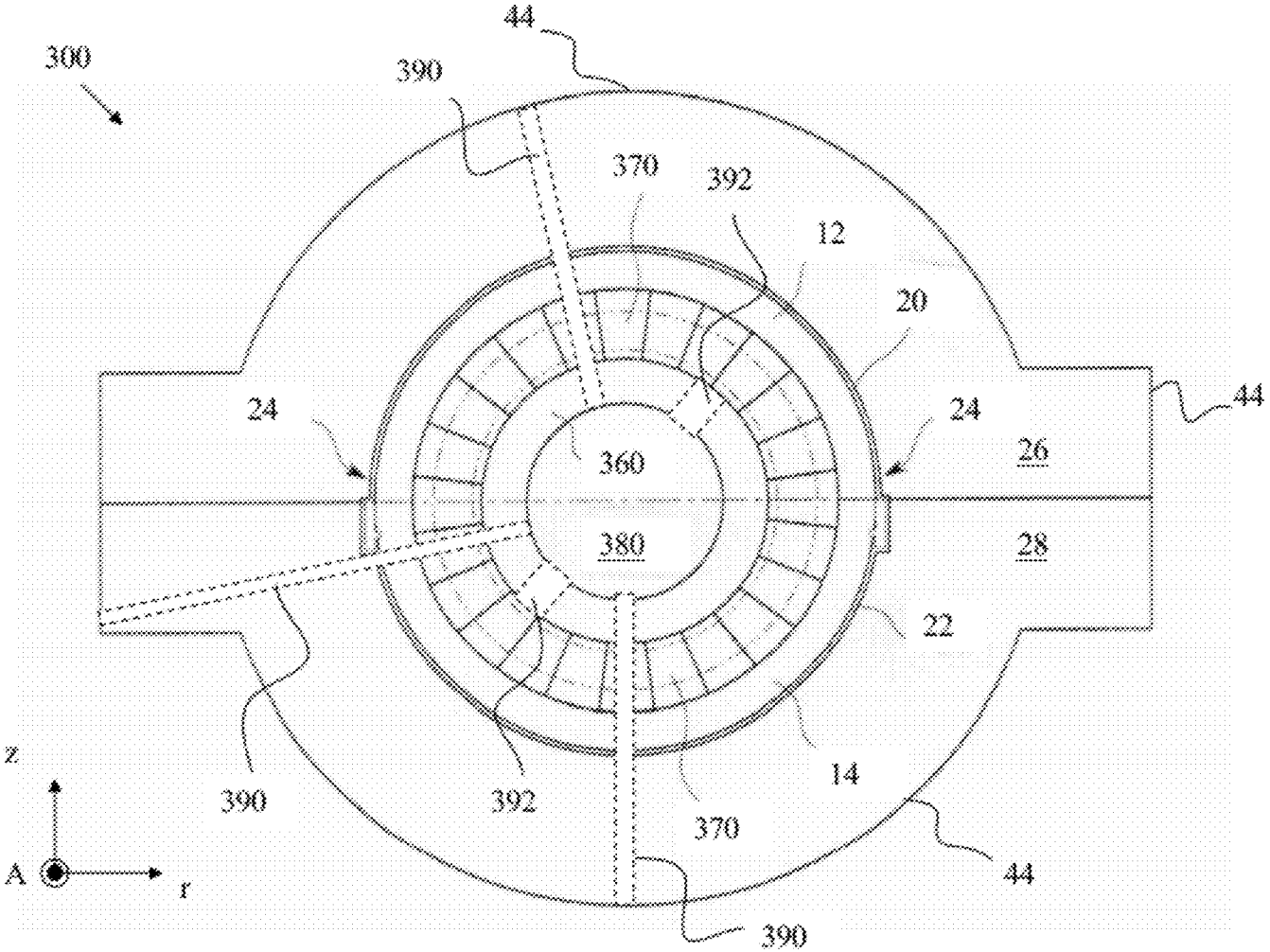
FIG. 4 shows a partial cross-sectional view of a steam turbine system according to embodiments of the invention.

FIG. 4 shows a partial cross-sectional view of a steam turbine system 300 according to embodiments of the invention. It is understood that similarly labeled elements between the Figures herein may represent substantially similar elements. It is further understood that path 46 and associated port 42 (as well as details of support bar 34) are omitted for clarity of illustration. As shown, steam turbine system 300 may include diaphragm ring segments 12, 14. Diaphragm ring segments 12, 14 are housed within casing segments 20, 22 (or, alternatively, 20 and 122, as shown and described with reference to other embodiments), respectively, which are joined at casing horizontal joint surface 24. In this depiction, casing horizontal joint surface 24 and diaphragm horizontal joint surface 16 are assumed to be aligned, and therefore, diaphragm horizontal joint surface 16 is omitted for clarity of illustration. Each diaphragm ring segment 12, 14, supports a semi-annular row of turbine nozzles 370 and an inner web 360, as is known in the art. The diaphragm ring segments 12, 14 collectively surround a rotor 380, as is known in the art. Also shown included in steam turbine system 300 is an aperture 390 (several shown) extending radially from the rotor 380 to the radially outward surface 44. Aperture 390 may be located axially (A-axis, into the page) between stages of the steam turbine system 300 (stages obstructed in this view), and in one embodiment, aperture 390 may be substantially sealed from the radially outward surface 44, via, e.g., a cover plate, plug, or other removably affixed seal. In another embodiment, one or more apertures 390 may extend through a turbine nozzle 370 and/or through a nozzle sidewall, thereby intersecting the steam flow path. In one embodiment, aperture 390 may be located at the bottom-dead-center location of steam turbine system 300, or slightly off from bottom dead center. In other embodiments, aperture 390 may be located proximate to the horizontal joint surfaces (16, 24) of casing and diaphragm. Further, multiple apertures 390 (e.g., four, approximately evenly spaced around the circumference of steam turbine system 300) may be formed within steam turbine system 300 to allow for access to the rotor 380 from a point external to the radially outward surface 44. In one embodiment, apertures 390 may be configured to receive a probe or other measurement member to calculate a distance between portions of casing, diaphragm and/or rotor. It is understood that apertures 390 are located between stages of steam turbine system 300, such that apertures 390 do not physically interfere with turbine nozzles 370 (indicated by phantom lines). In an alternative embodiment, one or more linear variable differential transformer(s) (LVDT) 392 may be placed between the rotor 380 and the diaphragm ring 12 (e.g., the turbine nozzles 370 within diaphragm ring 12) to collect and transmit data regarding positioning and movement of the diaphragm ring 12 and rotor 380. LVDT 392 may be any conventional linear variable differential transformer configured to transfer the physical movement of an element to which it is attached, to an electrical signal, as is known in the art. LVDT 392 may be hard-wired to a receiving system (e.g., a conventional receiver or other computerized system) or may be wirelessly connected to the receiving system. In any case, LVDT 392 may be configured to determine a position and/or movement of diaphragm ring 12 and rotor 380. In another embodiment, a conventional piezoelectric-based device and/or a conventional capacitance device may be used in place of LVDT 392 to determine position and/or movement of the diaphragm ring 12 and rotor 380. In some embodiments, these devices (e.g., LVDT 392, piezoelectric-based device or capacitance device) may only have to survive the initial static conditions of the steam turbine system 300. That is, in some embodiments, one or more of these types of devices will be relatively ineffective for collecting and/or transmitting positional or movement-related data after operation of the steam turbine system 300 begins.

In contrast to conventional steam turbine systems, steam turbine system 300 may allow for determination of the positional relationships between a rotor, diaphragm, and casing at one or more locations along the circumference of the system. Specifically, steam turbine system 300 may provide for measurement of positional relationships of its components while the system is closed (e.g., where casing segments 20, 22, diaphragm segments 12, 14 and rotor 380 are in place. This system 300 may reduce the time and expense of measurement associated with conventional systems that require removal of at least some components (e.g., casing, diaphragm and/or rotor) in order to conduce measurements.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine casing segment comprising:
a horizontal joint surface;
a pocket having a first opening at the horizontal joint surface and a second opening facing substantially radially outward; and
a port accessible from a radially outward surface of the steam turbine casing segment, the port fluidly connected to the second opening of the pocket.

2. The steam turbine casing segment of claim 1, further comprising an adjustment bolt within the port, the adjustment bolt extending at least partially into the pocket from the radially outward surface of the steam turbine casing segment.

3. The steam turbine casing segment of claim 1, further comprising a radially extending slot extending substantially parallel with the horizontal joint surface, the radially extending slot configured to receive an adjustment member.

4. The steam turbine casing segment of claim 1, wherein a portion of the pocket is located within a support arm, the support arm including a slot extending substantially parallel with the horizontal joint surface between the second opening of the pocket and the port.

5. The steam turbine casing segment of claim 4, wherein the support arm includes a surface substantially coplanar with the horizontal joint surface.

6. A steam turbine apparatus comprising:
a diaphragm segment;
a casing segment at least partially housing the diaphragm segment, the casing segment having:
a horizontal joint surface;
a pocket having a first opening at the horizontal joint surface and a second opening facing substantially radially outward; and
a port accessible from a radially outward surface of the steam turbine casing segment, the port fluidly connected to the second opening of the pocket;
a support member positioned within the pocket;
a support bar at least partially coupling the casing segment to the diaphragm segment, the support bar contacting the support member; and
an adjustment assembly within the port and contacting the support member, the adjustment assembly configured to actuate movement of the support bar via the support member.

7. The steam turbine apparatus of claim 6, wherein the support member is removably affixed to the casing segment at the pocket by at least one of: a bolt, a pin, a screw, or a dovetail connection.

8. The steam turbine apparatus of claim 6, wherein the adjustment assembly includes a substantially horizontally extending bolt.

9. The steam turbine apparatus of claim 8, wherein the substantially horizontally extending bolt has a lug extending at least partially beyond the radially outward surface of the steam turbine casing segment.

10. The steam turbine apparatus of claim 8, wherein the adjustment assembly further includes an adjustment member having an angled face.

11. The steam turbine apparatus of claim 10, wherein the support member includes an angled face being substantially complementary to the angled face of the adjustment member.

12. The steam turbine apparatus of claim 11, wherein the angled face of the adjustment member is configured to move across the angled face of the support member to actuate movement of the support member.

13. A steam turbine system comprising:

an upper casing segment; and a lower casing segment coupled to the upper casing segment at a casing horizontal joint surface, the lower casing segment including:

a pocket having a first opening at the horizontal joint surface and a second opening facing substantially radially outward; and a port accessible from a radially outward surface of the steam turbine casing segment, the port fluidly connected to the second opening of the pocket.

14. The steam turbine system of claim 13, further comprising a diaphragm ring including an upper diaphragm segment; and a lower diaphragm ring segment coupled to the upper diaphragm segment at a diaphragm horizontal joint surface, wherein the upper casing segment and the lower casing segment surround the diaphragm ring.

15. The steam turbine system of claim 14, further comprising:

a support member having an angled face positioned within the pocket;

a support bar at least partially coupling the upper casing segment to the lower diaphragm segment, the support bar contacting the support member at a face other than the angled face; and an adjustment assembly within the port contacting the support member, the adjustment assembly including an adjustment member having an angled face, the adjustment assembly being accessible from the radially outward surface of the steam turbine casing segment and being configured to adjust a position of the casing horizontal joint surface relative to a position of the diaphragm horizontal joint surface.

16. The steam turbine system of claim 14, further comprising a rotor positioned radially inside of the diaphragm ring.

17. The steam turbine system of claim 16, further comprising an aperture extending from the rotor to the radially outward surface between two stages of the steam turbine system, the aperture configured to receive a measurement probe.

18. The steam turbine system of claim 16, further comprising at least one of a linear variable differential transformer, a piezoelectric-based device, or a capacitance-based device, removably affixed to the diaphragm ring and in contact with the rotor.

* * * * *